US008635903B2

(12) United States Patent
Oetken et al.

(10) Patent No.: US 8,635,903 B2
(45) Date of Patent: Jan. 28, 2014

(54) METHOD AND SYSTEM FOR COMPACTION MEASUREMENT

(75) Inventors: Nicholas A. Oetken, Brooklyn Park, MN (US); James A. Aardema, Plymouth, MN (US); Kristopher A. Hanson, Stillwater, MN (US); Bryan J. Downing, Champlin, MN (US)

(73) Assignee: Caterpillar Paving Products Inc., Minneapolis, MN (US)

( * ) Notice: Subject to any disclaimer, the term of this patent is extended or adjusted under 35 U.S.C. 154(b) by 338 days.

(21) Appl. No.: 12/962,731

(22) Filed: Dec. 8, 2010

(65) Prior Publication Data

US 2011/0302998 A1 Dec. 15, 2011

Related U.S. Application Data

(60) Provisional application No. 61/289,114, filed on Dec. 22, 2009.

(51) Int. Cl.
*G01N 3/40* (2006.01)

(52) U.S. Cl.
USPC ..... 73/78; 73/32 R; 73/866; 404/83

(58) Field of Classification Search
USPC ..... 73/84, 78; 342/22
See application file for complete search history.

(56) References Cited

U.S. PATENT DOCUMENTS

| | | | | |
|---|---|---|---|---|
| 3,599,543 | A | 8/1971 | Kerridge | |
| 4,979,197 | A * | 12/1990 | Troxler et al. | 378/90 |
| 5,177,415 | A * | 1/1993 | Quibel et al. | 318/128 |
| 5,420,589 | A * | 5/1995 | Wells et al. | 342/22 |
| 5,493,494 | A | 2/1996 | Henderson | |
| 5,835,053 | A * | 11/1998 | Davis | 342/22 |
| 6,061,618 | A | 5/2000 | Hale et al. | |
| 6,188,942 | B1 | 2/2001 | Corcoran et al. | |
| 6,431,790 | B1 * | 8/2002 | Anderegg et al. | 404/75 |
| 6,460,006 | B1 | 10/2002 | Corcoran | |
| 6,536,553 | B1 * | 3/2003 | Scanlon | 181/108 |
| 6,577,141 | B2 * | 6/2003 | Gandrud | 324/663 |
| 7,239,150 | B2 * | 7/2007 | Troxler et al. | 324/643 |
| 7,669,458 | B2 * | 3/2010 | Commuri et al. | 73/32 A |
| 8,190,338 | B2 * | 5/2012 | Commuri | 701/50 |
| 2004/0035207 | A1 * | 2/2004 | Hamblen et al. | 73/573 |
| 2005/0150278 | A1 * | 7/2005 | Troxler et al. | 73/78 |
| 2006/0096354 | A1 * | 5/2006 | Commuri et al. | 73/32 A |
| 2007/0150147 | A1 | 6/2007 | Rasmussen et al. | |
| 2007/0276602 | A1 * | 11/2007 | Anderegg et al. | 702/2 |
| 2009/0126953 | A1 | 5/2009 | Anderegg et al. | |
| 2010/0172696 | A1 * | 7/2010 | Commuri | 404/117 |

* cited by examiner

*Primary Examiner* — Hezron E Williams
*Assistant Examiner* — Alexander Mercado
(74) *Attorney, Agent, or Firm* — Leonard D. Conapinski; Andrew A. Phillips

(57) ABSTRACT

A system for compaction measurement, including at least two compaction measurement systems for determining the compaction state of various portions of a material region at a worksite and a display system for displaying aggregated data from the compaction measurement systems.

20 Claims, 4 Drawing Sheets

METHOD AND SYSTEM FOR COMPACTION MEASUREMENT

CLAIM FOR PRIORITY

The present application claims priority from U.S. Provisional Application Ser. No. 61/289,114, filed Dec. 22, 2009, which is fully incorporated herein.

TECHNICAL FIELD

This disclosure relates generally to systems for compacting earth material. More specifically, a method and system is disclosed for compaction that more accurately determines the level of compaction using at least two different compaction measurement systems.

BACKGROUND

Construction projects such as road building projects require extensive and often costly procedures to ensure that the final product (e.g., road) meets requirements such as proper smoothness, elevation, load bearing capacity, etc. Often earth material at a worksite must be redistributed and one or more compactor machines employed to successively compact material until the desired level of compaction is achieved.

Worksites usually contain varying topology and soil composition. Moreover, different regions of a worksite might have varying compaction requirements. Systems to measure the state of compaction of a region of a worksite are known in the art. Despite the existence of automated or semi-automated methods of measuring the compaction state of a region of a worksite, there is a need for more accurate measurement methods. For example, different methods of measuring the compaction of a region have varying levels of accuracy at varying depths below the ground. Therefore, it is desirable for a system to optimally utilize data from multiple different compaction measurement systems, and to display the resulting data in a way that is meaningful for a machine operator and/or an automated compaction control system.

The present disclosure is directed to overcoming or mitigating one or more of the problems set forth above.

SUMMARY OF THE INVENTION

In one aspect, a method of compaction measurement including a step of determining data indicative of the compaction state of a first portion of a material region over a first depth range with a first compaction measurement system. A step of determining data indicative of the compaction state of a second portion of the material region over a second depth range with a second compaction measurement system, and wherein the second depth range is deeper than the first depth range, is also included. The method further includes a step of displaying data indicative of the compaction state of the first portion of the material region over a first display range. The method also includes a step of displaying data indicative of the compaction state of second portion of the material region over a second display range.

In another aspect, a system for measuring compaction, including a first compaction measurement system for determining the compaction state of a first portion of a material region over a first depth range. Also included is a second compaction measurement system for determining the compaction state of a second portion of the material region over a second depth range. Also included is at least one electronic control module operably connected to the first compaction measurement system and the second compaction measurement system. A display system operably connected to the electronic control module and configured to displaying data indicative of the compaction state of the first portion of the material region over a first display range and the compaction state of the second portion of the material region over a second display range is also included.

In another aspect, A machine including a compactor having a frame and a compacting element coupled with the frame. Also included is a first compaction measurement system for determining the compaction state of a first portion of a material region over a first depth range. Also included is a second compaction measurement system for determining the compaction state of a second portion of a material region over a second depth range. Also included is at least one electronic control module operably connected to the first compaction measurement system and the second compaction measurement system. Also included is a display system operably connected to the at least one electronic control module and configured to display output from the first compaction measurement system and the second compaction measurement system.

DETAILED DESCRIPTION

Figure 1:
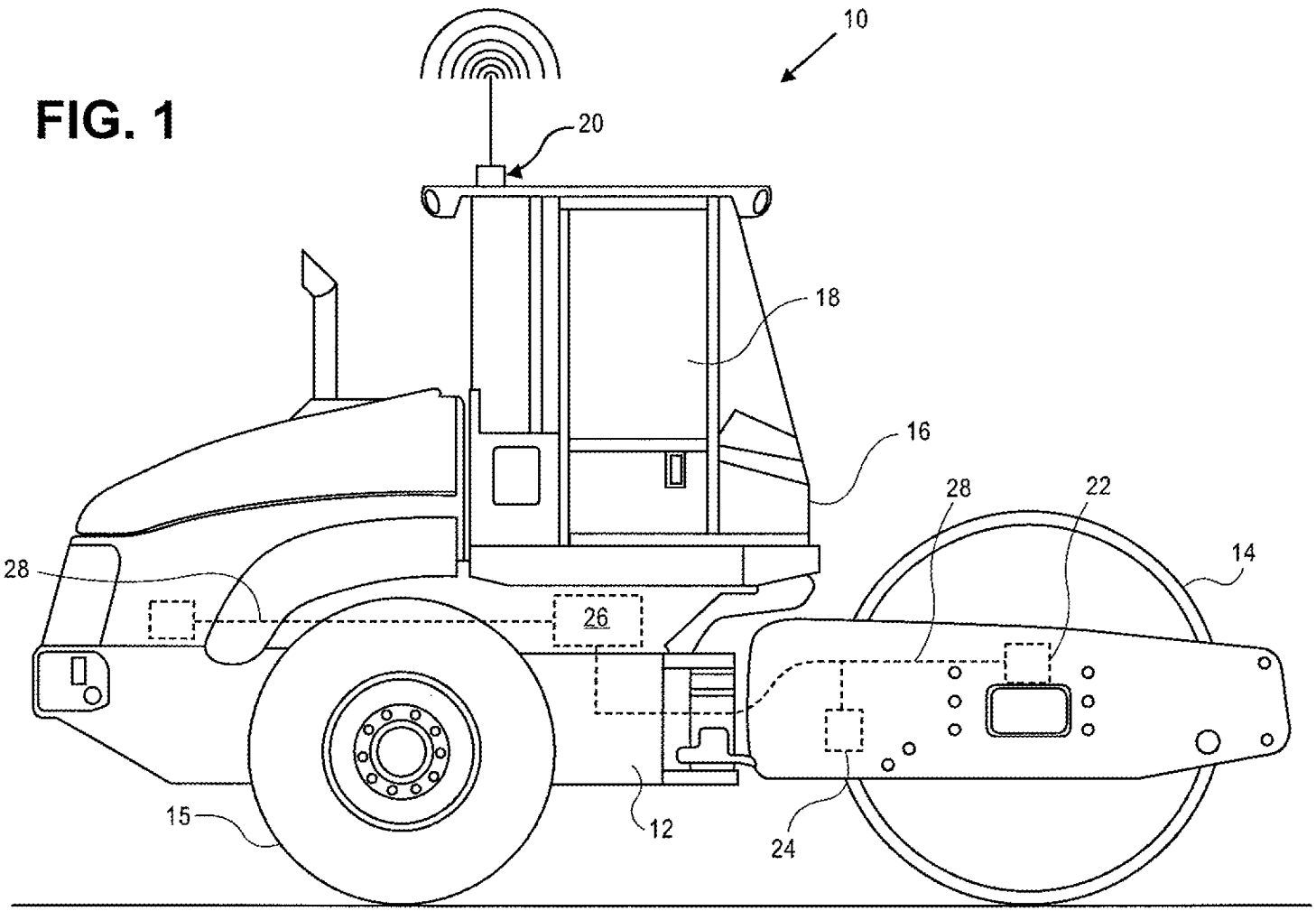
FIG. 1 shows a diagrammatic illustration of a compactor configured according to the present disclosure.

FIG. 1 shows an exemplary compactor 10 for use in compacting a work area. Compactor 10 includes a frame 12 attached to ground-engaging elements such as a drum 14 and wheels 15. Those skilled in the art will recognize that in some embodiments, a second drum could replace wheels 15. Compactor 10 includes a cab 16 attached to frame 12 for housing an operator, and includes typical operator controls such as steering wheel 18 for controlling operation of the machine. Compactor 10 may be any type of compactor known in the art.

A communication device 20 may be mounted on compactor 10 for sending and/or receiving signals. Signals can relate to characteristics such as the position, operating mode, or other aspects of compactor 10. Communication device 20 may also receive signals relating to characteristics of the worksite, or control signals to operate compactor 10 within the work area. Communication device 20 may also be employed to send data from compactor 10 relating to a compaction state of a material region at a worksite, for example, the data generated by one or more compaction measurement systems on compactor 10, as discussed in more detail below.

Compactor 10 also includes an electronic control module 26 for receiving and sending signals relating to the operation and control of machine, as further described herein. For example, electronic control module 26 may receive signals from a first compaction measurement system 22 and a second compaction measurement system 24, as well as a sensor, via communication lines 28. Electronic control module 26 also optionally sends and receives signals related to other aspects of operation of the machine, such as signals to motors, pumps, or communications devices on compactor 10. Further, although electronic control module 26 is represented as a signal component on compactor 10 in FIG. 1, control of the machine may be achieved by using a plurality of electronic control modules, operably connected, to control various different tasks and to coordinate data processing from one or more compaction measurement systems installed on or connected to compactor 10.

First compaction measurement system 22 may include one or more sensors or electronic equipment configured to gather data directly or indirectly indicative of a compaction response of a material region with which compactor 10 is interacting. For example, first compaction measurement system 22 may be configured to provide a signal indicative of the compaction state of a material region by measuring the rolling resistance of compactor 10 as it passes over a material region. Compaction measurement techniques by this method are described in U.S. Pat. No. 6,188,942, incorporated herein by reference ("the '942 patent"). The '942 patent discloses a method and system of determining compaction performance of a material by calculating the compactive energy delivered to the material, for example, as a function of the known compaction width, the lift thickness of the material, and the rolling resistance of the compactor. Thus, first compaction measurement system 22 may comprise one or more sensors and electronic systems configured to provide a measurement of compaction performance from compactive energy calculations. As described in the '942 patent, sensors such as a ground speed sensor, inclinometer, and torque sensors may be utilized to determine compaction performance.

Compactor 10 is also equipped with a second compaction measurement system 24. Second compaction measurement system 24 may be one of the compaction measurement systems discussed above, or an alternate method for measuring compaction. For example, second compaction measurement system 24 may be composed of an accelerometer to measure movement of the drum of a compactor, such as drum 14 of compactor 10 in FIG. 1. This type of system measures the stiffness of the material, or the ability of the material to resist deformation under a load. An accelerometer measures drum movement, which is converted into stiffness values indicative of the state of compaction of the material.

Alternatively, first compaction system 22 or second compaction measurement system 24 may be other measurement device, such as a nuclear density gauge or a deflectometer. The present disclosure appropriately covers other known means of measuring compaction of a material beyond the exemplary methods discussed in detail herein.

Figure 2:
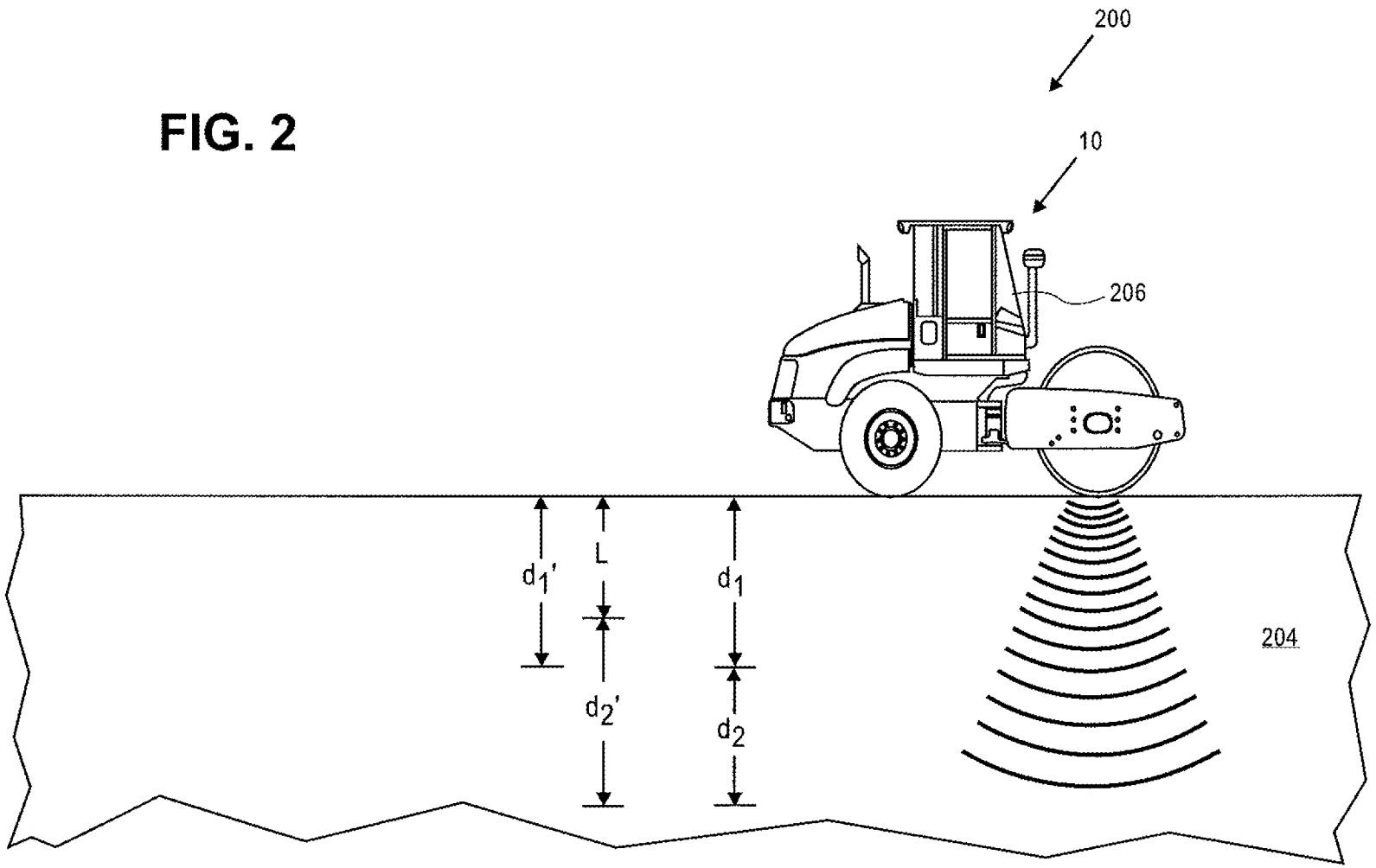
FIG. 2 illustrates an exemplary compaction system at a worksite.

FIG. 2 shows a compaction system 200 at a worksite. As compactor 10 travels over a material region 204, one or more measurements is taken of material region 204 to determine the level of compaction of material region 204. First compaction measurement system 22 may measure of level of compaction a first portion of the material region 204 over a first depth length, such as $d_1$ in FIG. 2. Second compaction measurement system 24 may measure the level of compaction of second portion of the material region 204 over second depth length, such as depth $d_2$ in FIG. 2. For example, $d_1$ may be 0.5 meters, therefore first compaction measurement system 22 thus measures the level of compaction of the first portion of the material region 204 between 0 and 0.5 meters below ground. Similarly, $d_2$ may be 1.5 meters in length, meaning that second compaction measurement system 24 measures the level of compaction of second portion of the material region 204 between 0.5 and 2 meters below ground. In this example, the two different compaction measurement systems on compactor 10 measure the level of compaction of different, mutually exclusive depths of the various portions of the material region 204.

Alternatively, however, the different compaction measurement systems may measure differing, but overlapping, depths of material region 204. Returning to FIG. 2, first compaction measurement system 22 may measure the level of compaction of first portion of the material region 204 to a depth of $d'_1$, and second compaction measurement system 24 may measure the level of compaction of second portion of the material region 204 at a depth of $d'_2$ beginning at depth L. For example, first compaction measurement system 22 may measure compaction from a depth of 0 to 0.75 meters, while second compaction measurement system 24 may measure compaction between 0.5 and 2 meters. In this example, both compaction measurement systems take a reading of an overlapping depth, namely, between 0.5 and 0.75 meters below ground. In this situation, there are various different possibilities for handling the overlapping data to be displayed to the operator. One possibility is that the electronic control module ignores a portion of the data from one of the compaction measurement systems. Thus, in the example above, the electronic control module may display data from a first compaction system from 0 to 0.5 meters, and display data from the second compaction system from 0.5 to 2 meters, thus ignoring the data from the first compaction measurement system between 0.5 and 0.75 meters.

Alternatively, the electronic control module may average the data when one a plurality of compaction systems returns data at the same depth below ground. In another alternative, the electronic control module may compute a weighted average, weighting the data from one of the plurality of compaction measurement systems more heavily if, at that particular depth, there is reason to believe that one of the compaction measurement systems may provide more accurate data than another compaction measurement system.

Figure 3:
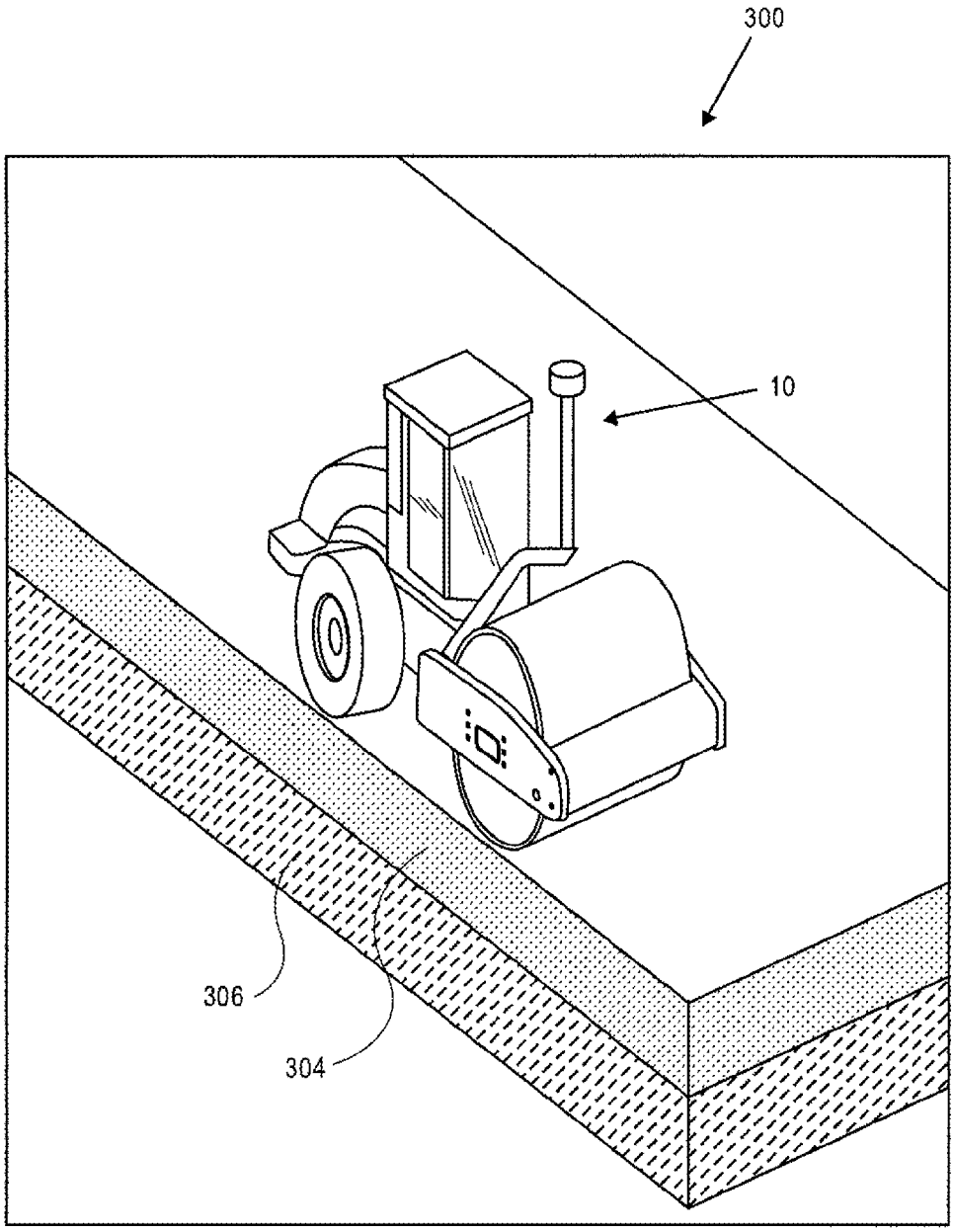
FIG. 3 illustrates an exemplary display screen showing an isometric view of a material region and compactor at a worksite.

FIG. 3 illustrates an exemplary display screen 300 showing an isometric view of a material region of a worksite, data regarding a material region, and a compactor 10. Display screen 300 may be on a compaction machine at a worksite, such as compactor 10 in FIG. 1, and/or may be displayed at another location of the worksite (e.g., a management station), or remotely from the worksite altogether.

Display screen 300 optionally shows compactor 10, including the present position of compactor 10, to orient the operator to the material region at the worksite being displayed. Display screen 300 also shows at least two different compaction depth regions, represented by depth region 304 and depth region 306. For each depth region displayed, a visual indication is provided to show the level of compaction of the depth region. For example, depth region 304 may be represented on display screen 300 in the color blue, with darker shades of blue indicating that the material in depth region 304 is more compacted, and lighter shades of blue indicating that the material in depth region 304 is less compacted. Depth region 306 may then be represented in the color red, with darker shades of red indicating that the material in depth region 306 is more compacted, and lighter shades of read indicating that the material in depth region 306 is less compacted. In this fashion, the operator can see the level of compaction at two different depth ranges on a single display screen, with data gathered from two different compaction measurement systems.

Variations of the display system above may also be used. For example, different shading or other graphics may be used in place of colors, both to show the level of compaction and to separate between two or more different depth regions. Different colors may also be used to signify compaction performance, such as green to indicate that a material region is sufficiently compacted, or red to indicate that a material region is not sufficiently compacted. Likewise, the colors or other graphics may indicate the quantitatively measured levels of compaction, or alternatively may indicate the relative level of compaction compared to a target level of compaction for the material region.

In addition, display screen 300 need not show two or more discrete depth regions on the display. In other words, compactor 10 may be equipped with a plurality of compaction measurement systems, but the measurements from these systems may be combined in such a way as to seamlessly display the overall level of compaction of a depth region to the operator, without the operator realizing that the display screen has aggregated data from more than one compaction measurement system. Thus display screen 300 may be configured to show just a single depth region that displays aggregated measurements from the plurality of compaction measurement systems. In addition, display screen 300 need not display all of the possible data gathered by the compaction measurement systems. That is, if display screen 300 shows two different display depth on screen for a region of material, these display ranges need not exactly correspond with the depth ranges for which each compaction measurement system is able to gather data.

Figure 4:
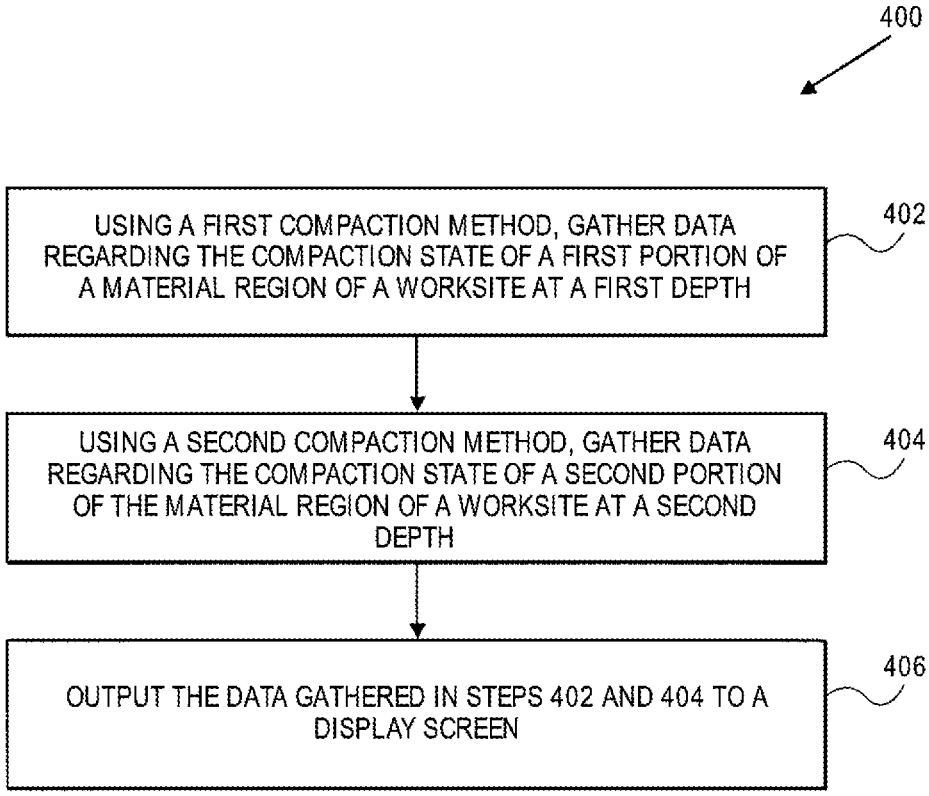
FIG. 4 illustrates a flowchart showing an exemplary method for measuring a state of compaction of a material region at a worksite.

FIG. 4 illustrates a flowchart showing an exemplary method 400 for measuring a state of compaction of a material region at a worksite. In the first step, step 402, a first compaction measurement system (such as those described above) is used to gather data indicative of the compaction state of a first portion of a material region. In the next step, step 404, a second compaction measurement system is used to gather data indicative of the compaction state of a second portion of the material region. In the third step, step 406, the data gathered is output to display the data gathered from the first and second compaction measurement systems. Variations of these steps of the method may utilized as previously discussed.

INDUSTRIAL APPLICABILITY

The present disclosure provides an advantageous system and method for accurately determining the compaction response of various portions of a material region on a worksite. The system and method allow an operator to get an accurate indication of the compaction response of one or more materials at varying depths, in a manner that is easily synthesized so that the operator (or an automated control system) can take appropriate action to ensure that the various portions of the material region are properly and efficiently compacted. The system draws on the relative strengths of two different compaction measurement systems that may have different degrees of accuracy in measuring the state of compaction at different depths of material within the region.

Other embodiments, features, aspects, and principles of the disclosed examples will be apparent to those skilled in the art and may be implemented in various environments and systems.

What is claimed is:

1. A method of compaction measurement comprising the steps of:

determining data indicative of the compaction state of a first portion of a material region over a first depth range with a first compaction measurement system under a compacting element;

determining data indicative of the compaction state of a second portion of the material region over a second depth range with a second compaction measurement system under the compacting element, and wherein the second depth range is deeper than the first depth range;

displaying data indicative of the compaction state of the first portion of the material region over a first display range; and displaying data indicative of the compaction state of second portion of the material region over a second display range;

wherein the steps of determining the compaction state of a first portion of the material region over a first depth range, and determining the compaction state of a second portion of the material region over a second depth range occur substantially simultaneously.

2. The method of claim 1, wherein displaying data includes a visual representation of the compaction state of the first portion of the material region over at least a portion of the first depth range, and further includes a visual representation of the compaction state of the second portion of the material region over at least a portion of the second depth range.

3. The method of claim 1, wherein the steps of determining the compaction state of the first portion of the material region over the first depth range, and determining the compaction state of the second portion of the material region over the second depth range occur during a single compactor pass over the material region.

4. The method of claim 1, wherein the first depth range and the second depth range include overlapping depth ranges.

5. The method of claim 1, wherein the first display range equals the first depth range.

6. The method of claim 5, wherein the second display range equals the second depth range.

7. The method of claim 1, wherein the first portion of the material region comprises a first material, and the second portion of the material region comprises a second material, and wherein the first material and the second material are the same.

8. A system for measuring compaction, comprising:

a first compaction measurement system for determining the compaction state of a first portion of a material region over a first depth range under a compacting element;

a second compaction measurement system for determining the compaction state of a second portion of the material region over a second depth range under the compacting element;

at least one electronic control module operably connected to the first compaction measurement system and the second compaction measurement system; and a display system operably connected to the electronic control module and configured to displaying data indicative of the compaction state of the first portion of the material region over a first display range and the compaction state of the second portion of the material region over a second display range;

wherein the first compaction measurement system and the second compaction measurement system are configured to measure the compaction state of the first portion of the material region and compaction state of the second portion of the material region substantially simultaneously.

9. The system of claim 8, wherein the display system includes a visual representation of the compaction state of the first portion of the material region over at least a portion of the first depth range, and further includes a visual representation of the compaction state of the second portion of the material region over at least a portion of the second depth range.

10. The system of claim 8, wherein the display system is further configured to display an isometric view of a compactor.

11. The system of claim 8, wherein the display system is attached to a compactor containing the first compaction measurement system and the second compaction measurement system.

12. The system of claim 8, wherein the display system displays the first display range and second display range in a visually distinct manner.

13. The system of claim 8, wherein the first portion of the material region comprises a first material, and the second portion of the material region comprises a second material, and wherein the first material and the second material are the same.

14. A machine comprising:

a compactor having a frame and a compacting element coupled with the frame;

a first compaction measurement system for determining the compaction state of a first portion of a material region over a first depth range under the compactor element;

a second compaction measurement system for determining the compaction state of a second portion of a material region over a second depth range under the compacting element;

at least one electronic control module operably connected to the first compaction measurement system and the second compaction measurement system; and a display system operably connected to the at least one electronic control module and configured to display output from the first compaction measurement system and the second compaction measurement system;

wherein the first compaction measurement system and the second compaction measurement system are configured to measure the compaction state of the first portion of the material region and compaction state of the second portion of the material region substantially simultaneously.

15. The machine of claim of 14, wherein the first compaction measurement system is configured to measure the compaction state of the first portion of the material region by providing data indicative of the rolling resistance of the compactor as it passes over the material region.

16. The machine of claim of 14, wherein the second compaction measurement system is configured to measure the compaction state of the second portion of the material region by providing data indicative of the rolling resistance of the compactor as it passes over the material region.

17. The machine of claim of 14, wherein the first compaction measurement system is configured to measure the compaction state of the first portion of the material region by providing data from an accelerometer coupled to the compacting element.

18. The machine of claim of 14, wherein the second compaction measurement system is configured to measure the compaction state of the second portion of the material region by providing data from an accelerometer coupled to the compacting element.

19. The machine of claim 14, wherein the display system is further configured to display an isometric view of the compactor.

20. The machine of claim 14, wherein the first compaction measurement system and second compaction measurement system are configured to output signals including electronic data indicative of a compaction state of the first portion of the material region and the compaction state of the second portion of the material region substantially simultaneously.

* * * * *